US010242517B1

(12) United States Patent
Nye et al.

(10) Patent No.: US 10,242,517 B1
(45) Date of Patent: Mar. 26, 2019

(54) GARAGE DOOR STATUS AND CONTROL VIA A SECURITY SYSTEM

(71) Applicant: Vivint, Inc., Provo, UT (US)

(72) Inventors: James Ellis Nye, Alpine, UT (US); Michael D. Child, Lehi, UT (US); Jeffrey G. Thomas, Draper, UT (US); Jeremy B. Warren, Draper, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 15/707,694

(22) Filed: Sep. 18, 2017

Related U.S. Application Data

(63) Continuation of application No. 14/179,312, filed on Feb. 12, 2014, now Pat. No. 9,767,631.

(60) Provisional application No. 61/792,399, filed on Mar. 15, 2013.

(51) Int. Cl.
*G07C 9/00* (2006.01)
*G08B 13/08* (2006.01)

(52) U.S. Cl.
CPC ..... *G07C 9/00126* (2013.01); *G08B 13/08* (2013.01); *G07C 2009/00928* (2013.01)

(58) Field of Classification Search
CPC ..... G07C 9/00126; G07C 2009/00928; G08B 13/08; G08B 13/00
See application file for complete search history.

(56) References Cited

U.S. PATENT DOCUMENTS 4,338,526 A * 7/1982 Martin ..... E05F 15/72 307/116
5,565,843 A * 10/1996 Meyvis ..... G08B 5/36 340/326
5,780,987 A * 7/1998 Fitzgibbon ..... E05F 15/668 318/16
5,781,107 A * 7/1998 Ji ..... G08B 13/08 340/522
6,184,787 B1 * 2/2001 Morris ..... E05F 15/00 340/517
6,192,282 B1 * 2/2001 Smith ..... G05B 15/02 340/12.53
6,310,548 B1 10/2001 Stephens, Jr. et al.
6,392,560 B1 * 5/2002 Stuehling ..... G08B 13/1427 340/309.7
7,468,676 B2 12/2008 Styers et al.
7,602,283 B2 10/2009 John
2002/0180600 A1 * 12/2002 Kirkland ..... G08B 13/08 340/545.1
2005/0174250 A1 * 8/2005 Dierking ..... G07C 9/00309 340/686.1
2005/0253710 A1 * 11/2005 Eskildsen ..... G08B 13/08 340/545.5
2006/0158339 A1 * 7/2006 Brundula ..... E05F 15/77 340/686.1
2006/0187034 A1 * 8/2006 Styers ..... G05B 9/02 340/545.1

(Continued)

*Primary Examiner* — Thomas D Alunkal
(74) *Attorney, Agent, or Firm* — Holland & Hart LLP

(57) ABSTRACT

Methods, systems, and devices are described that are directed to status and control of a garage door system via an alarm system controller. A garage door system may include one or more garage doors and at least one sensor configured to sense data indicative of a status of a garage door of the one or more garage doors. The at least one sensor may further be configured to convey the sensed data to an alarm system controller.

19 Claims, 5 Drawing Sheets

(56) References Cited

U.S. PATENT DOCUMENTS

| | | | | |
|---|---|---|---|---|
| 2006/0202815 | A1 | 9/2006 | John | |
| 2006/0220834 | A1* | 10/2006 | Maeng | G08B 21/24 340/539.1 |
| 2008/0062000 | A1* | 3/2008 | Styers | G05B 9/02 340/686.1 |
| 2008/0079570 | A1 | 4/2008 | Fineman et al. | |
| 2010/0171588 | A1 | 7/2010 | Chutorash et al. | |
| 2010/0289618 | A1* | 11/2010 | Crucs | G08C 17/00 340/5.61 |
| 2010/0289661 | A1* | 11/2010 | Styers | G05B 9/02 340/686.1 |
| 2012/0260575 | A1* | 10/2012 | Monaco | E05F 15/668 49/13 |
| 2013/0321127 | A1* | 12/2013 | Wilder | G05B 19/042 340/5.71 |

* cited by examiner

GARAGE DOOR STATUS AND CONTROL VIA A SECURITY SYSTEM

CROSS REFERENCES

The present Application is a continuation of U.S. Provisional patent application Ser. No. 14/179,312, titled: "GARAGE DOOR STATUS AND CONTROL VIA A SECURITY SYSTEM," filed on Feb. 12, 2014, which claims priority to U.S. Provisional Patent Application No. 61/792,399, titled: "GARAGE DOOR STATUS AND CONTROL VIA A SECURITY SYSTEM," filed on Mar. 15, 2013. The disclosures of each of which are included herein by reference.

TECHNICAL FIELD

This disclosure relates generally to security systems and, more specifically, to garage door status and control via a security system.

BACKGROUND

Security systems are widely used to protect property and for personal safety. Security systems generally include a control panel, which controls the overall operation of the system, one or more keypads for user access to the system, and various detectors and sensors.

Security systems may generate an alarm in response to any number of events, such as unauthorized entry, fire, a medical emergency, or manual alarm activation. Further, a security system may be associated with a service that remotely monitors the status of the security system. Thus, if the security system generates an alarm, a notification signal may be transmitted via a wired and/or wireless communications link to a central station. Upon receiving the notification signal, security service personnel at the central station may attempt to contact the property owner (i.e., the party at the secured location) to verify the alarm. If it is appropriate to do so, the security service personnel may, upon confirmation of the alarm, contact an emergency response agency (e.g., the police department, the fire department, or an emergency medical team, etc.).

Security systems have therefore enhanced the ability of homeowners and businesses to monitor their premises and to protect against break-ins and the crimes that can accompany them (e.g., theft, damage to property, assault and battery, stalking, intrusion into privacy, etc.).

BRIEF SUMMARY OF THE INVENTION

In one embodiment, a centralized garage door control and management method is described. At least one of a garage door status query request or a garage control command is sent to a garage door control peripheral. At least one of the garage door status query request or the garage control command is received at the garage door control peripheral. A garage door status may be transmitted to a controller.

In one example, the garage door status may be transmitted to the controller at pre-defined intervals. In one configuration, the garage door control peripheral may be associated with a legacy garage door opener. A change of state of the garage door may be sensed. In one example, a signal indicative of a garage door status change may be detected. A relay control device may be toggled from a first position to a second position in response to the detected signal.

At least one of an audible alert or a visual alert may be conveyed proximate the garage door at least one of prior to, during, or after a garage door change of state. One or more garage control commands may be convened from the controller to the peripheral garage control unit. One or more of the garage door commands may be converted.

A centralized garage door control and management system is also described. The system may include a controller, and a garage door control peripheral. The garage door control peripheral may be configured to receive at least one of a garage door status query request or a garage door command from the controller, and transmit a garage door status to the controller. The system may further include a garage door system control and a garage door system.

A computer program product for a centralized garage door control and management system is also described. The computer program product may include a non-transitory computer readable medium storing instructions executable by a processor to send at least one of a garage door status query request or a garage control command to a garage door control peripheral, receive at a garage door control peripheral at least one of the garage door status query request or the garage control command, and transmit the garage door status to a controller.

A centralized garage door control and management system is further described. The system may include means for sending at least one of a garage door status query request or a garage control command to a garage door control peripheral, means for receiving at a garage door control peripheral at least one of the garage door status, query request, or the garage control command, and means for transmitting the garage door status to a controller.

In one embodiment, a garage door system may include one or more garage doors and at least one sensor configured to sense data indicative of a status of a garage door of the one or more garage doors. The sensor may also be configured to convey the sensed data to an alarm system controller.

In yet another specific embodiment, an alarm system comprises a garage door system including a sensor for detecting a garage door status change and conveying a signal indicative thereof. The alarm system may also include an alarm system controller including a relay control device configured for toggling from one position to another position upon receipt of the signal from the sensor. According to another specific embodiment, the alarm system controller may also include a module to receive a signal indicative of a status of a garage door and an interface configured to transmit one or more commands for controlling the garage door.

Of course, methods of operating an alarm system are also within the scope of the present systems and methods. Such a method may include sensing a status of a garage door and conveying sensed data indicative of the status of the garage door to an alarm system controller.

In another specific embodiment, a method may include querying a garage door system for a status of a garage door and receiving sensed data indicative of the status of a garage door at an alarm system controller.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
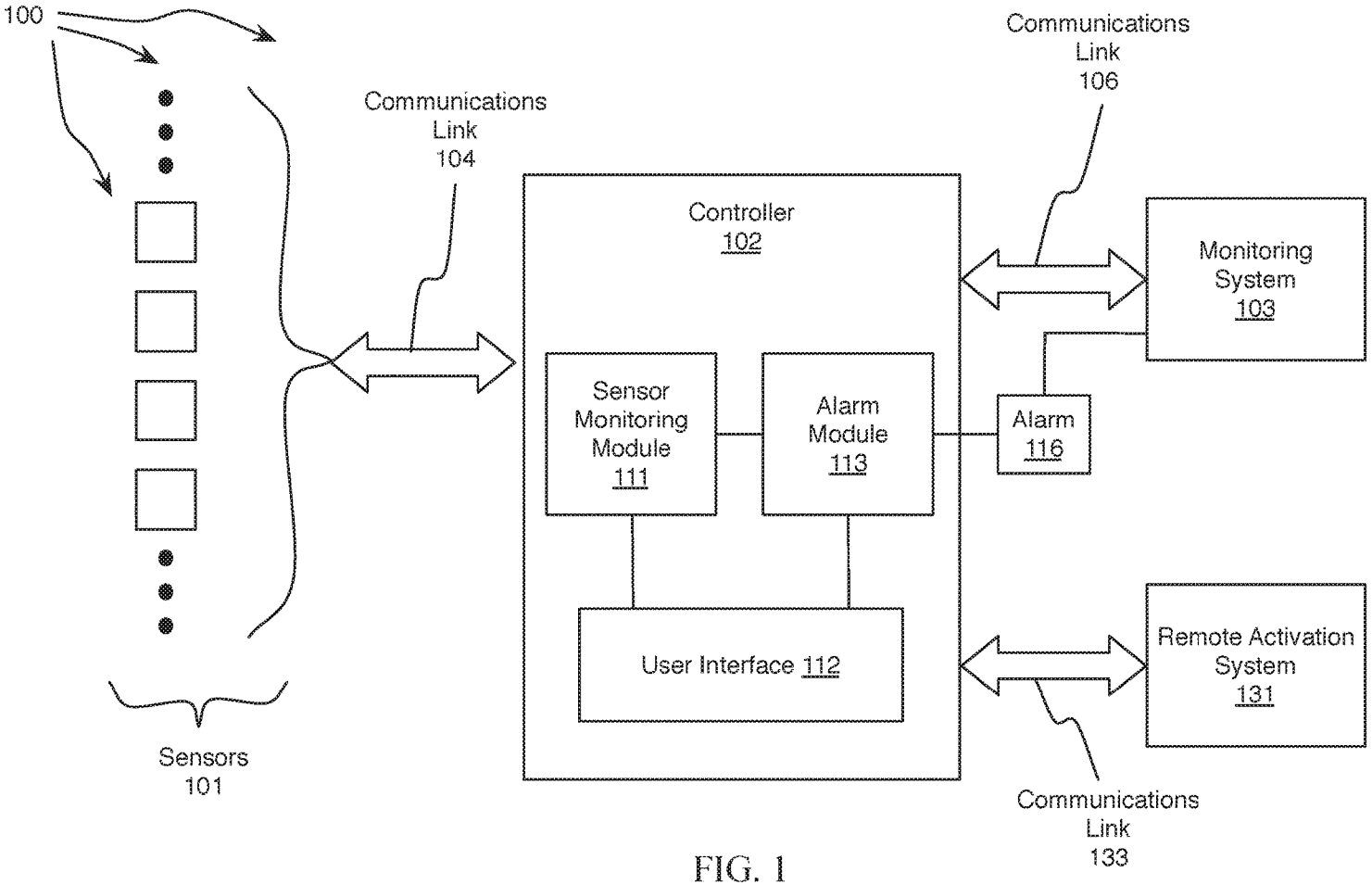
FIG. 1 illustrates an embodiment of a security system.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Referring in general to the accompanying drawings, various embodiments of the present systems and methods are illustrated to show the structure and methods for installing a component within a system, such as a security system. Common elements of the illustrated embodiments are designated with like numerals. It should be understood that the figures presented are not meant to be illustrative of actual views of any particular portion of the actual device structure, but are merely schematic representations which are employed to more clearly and fully depict embodiments of the present systems and methods.

The following provides a more detailed description of the present systems and methods and various representative embodiments thereof. In this description, functions may be shown in block diagram form in order not to obscure the present systems and methods in unnecessary detail. Additionally, block definitions and partitioning of logic between various blocks is exemplary of a specific implementation. It will be readily apparent to one of ordinary skill in the art that the present systems and methods may be practiced by numerous other partitioning solutions. For the most part, details concerning timing considerations and the like have been omitted where such details are not necessary to obtain a complete understanding of the present systems and methods and are within the abilities of persons of ordinary skill in the relevant art.

In this description, some drawings may illustrate signals as a single signal for clarity of presentation and description. It will be understood by a person of ordinary skill in the art that the signal may represent a bus of signals, wherein the bus may have a variety of bit widths and the present systems and methods may be implemented on any number of data signals including a single data signal.

As noted above, a security system may include one or more sensors linked to a controller, which may include an interface that can be used by a user. It is noted that a "controller" may also be referred to herein as a "control unit" or a "control panel." Further, it is noted that the term "security system" as used herein may also include "automation systems." Thus, although the present systems and methods is described with reference to "security systems," the systems and methods is not so limited. Rather, the present systems and methods may include any security, alarm, or automation (e.g., home or business) systems.

Via a controller, a user may arm (e.g., when leaving their residence) and disarm (e.g., when entering their residence) the security system. The controller may provide other functionality, such as a physical duress alarm, two-way voice communication, a siren, etc. Security sensors may be configured to monitor for various events. For example, a door/window sensor may be configured to detect when a door/window has been opened, a motion detector may be configured to detect motion. Other sensors may be configured to detect breaking of glass.

In addition to a local controller, which monitors sensor activity on premises, a security system may include a central monitoring system. For residential security systems, a remote central monitoring system may be a third party vendor. For commercial and industrial security systems, security or other personnel may monitor the premises. In commercial and industrial settings, the controller can be integrated into a larger security system. In any event, when sensor monitoring is activated and a sensor indicates a physical disturbance, the controller can activate an alarm. In response to an alarm, the controller can activate an audible siren and/or send an indication of the alarm to a central monitoring entity via a security event signal. The central monitoring entity can then initiate a response, such as contacting the owner of the premises, sending security personnel, contacting authorities, or a combination thereof.

FIG. 1 illustrates an embodiment of a security system 100, which may also be referred to as an "alarm system." Security system 100 includes sensors 101, a controller 102, a monitoring system 103, and a remote activation system 131. Communication links 104 (e.g., a combination of wired and wireless communication links) couple sensors 101 to control unit 102. Wired communication links can include circuit loops that are either detected as closed or open. In some embodiments, sensors 101 and controller 102 are located on the same premises, such as in the same residence or in the same building. Communication link 106 (e.g., a wired telephone connection, wired or wireless network connection, cellular connection, etc., or combination thereof) couples controller 102 to monitoring system 103.

Generally, sensors 101 include any of a variety of different types of sensors, such as door and window sensors, motion sensors, glass break sensors (e.g., detecting a physical break or detecting the sound of a glass break), etc.

Generally, controller 102 is configured to monitor sensors 101 for alarm conditions via communication links 104 and relay alarms to monitoring system 103 via communication link 106.

Controller 102 includes sensor monitoring module 111, user interface 112, and alarm module 113. Sensor monitoring module 111 is configured to monitor sensors 101. Sensors 101 can sense and/or indicate a change in their physical surroundings (e.g., a normally closed connection becomes open, a signal indicating that the sound of breaking glass was detected, etc.), which may be indicative of an unauthorized access, on communication links 104. For example, a circuit connected to a door sensor can transition from closed to open (or at least to a resistance exceeding a pre-determined resistance threshold) indicating that a door has been opened. A motion sensor can send an electrical signal indicative of detected motion. Sensor monitoring module 111 may monitor communication links 104 for indications and signals sent from sensors 101. Upon sensor monitoring module 111 receiving an indication or signal of a change in physical surroundings, sensor monitoring module 111 may send the indication or signal to alarm module 113. When appropriate, alarm module 113 can treat a monitored indication or signal from a sensor as an alarm condition.

User interface 112 can include an input interface and an output interface. The input interface can comprise a physical input interface or virtual input interface that includes one or more of a numeric key pad (e.g., for entering a disarm code, etc.), sensor activation buttons, physical duress buttons, etc. The input interface can also include a condenser for receiving audio input and/or communicating with monitoring system 103. The output interface includes an output display device that displays system status, such as armed, disarmed, sensors/zones that have detected change in physical surroundings, etc. The output interface can also include a speaker that audibly outputs information similar to that displayed on the output display device. The speaker can also be used by monitoring system 103 to communicate with a user of controller 102.

Figure 2:
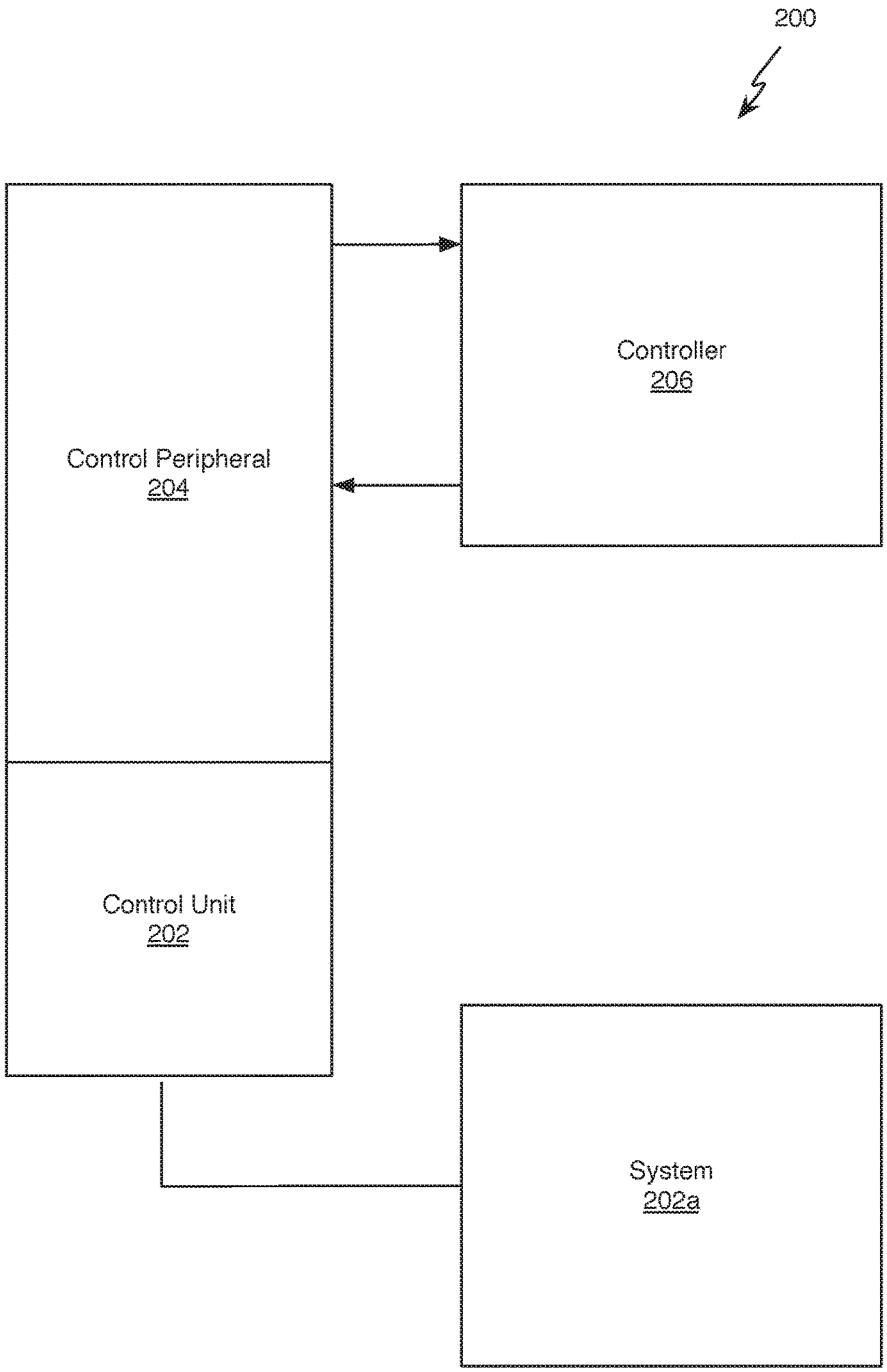
FIG. 2 is a block diagram of a control unit of a security system, according to an embodiment of the present disclosure.

FIG. 2 illustrates an embodiment of a control system 200 including a control unit 202 for controlling operation of a system 202*a*, which may comprise a garage door system. As depicted, system 200 includes control unit 202, a control peripheral 204 that interfaces with control unit 202, and a controller 206 that communicates with control peripheral 204. Controller 206 may comprise controller 102 depicted in FIG. 1. According to one embodiment, as illustrated in FIG. 3, control system 200 (e.g., see FIG. 2) may comprise a garage door control system 300 for operating one or more garage doors via a controller (e.g., a control panel).

Figure 3:
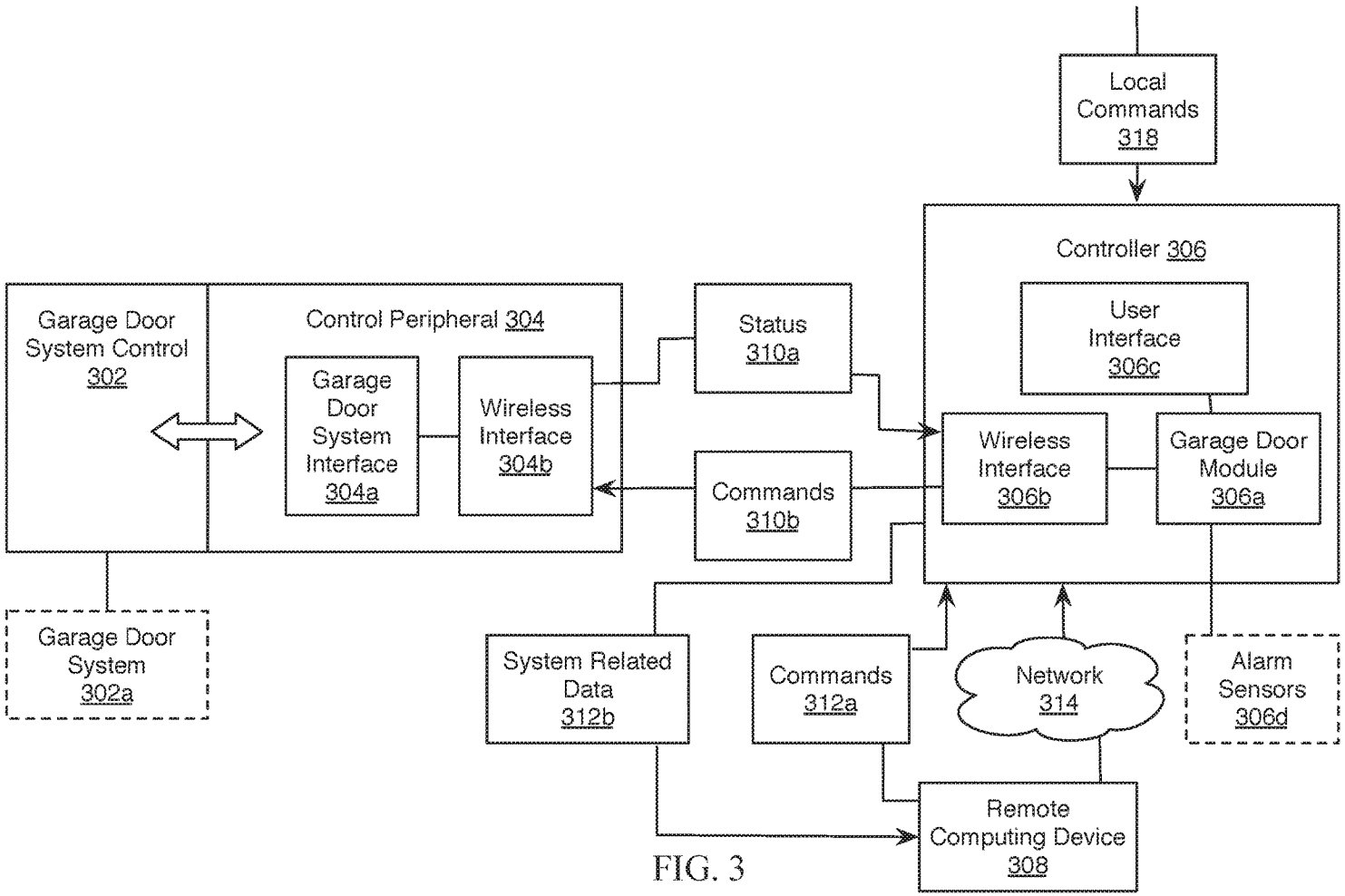
FIG. 3 illustrates a garage door control system, in accordance with an embodiment of the present disclosure.

As depicted in FIG. 3, garage door control system 300 includes a garage door system 302*a*, a garage door system control 302, a garage door control peripheral 304 that interfaces with the garage door system control 302, and a controller 306 that communicates with garage door control peripheral 304. Garage door system 302*a* may comprise one or more garage doors. Further, controller 306 may comprise controller 102 illustrated in FIG. 1.

Whereas conventional garage door controls are exclusively managed using one or more dedicated controls (e.g., remote unit, keypad, and/or wall console), garage door control system 300 integrates a conventional garage door control 302 with controller 306, and manages one or more garage doors of garage door system 302*a* through controller 306. Managing garage doors systems centrally using controller 306 integrates garage door management into a larger home automation scheme.

Garage door system control 302 can, in one or more embodiments, comprise a conventional garage door system control that controls operation of one or more garage doors. Thus, garage door control system 300 can be built around existing garage door controls without replacing garage door control hardware. As will be appreciated, conventional garage door systems may require physical presence of an operator at, or near, the garage door system to interact with the garage door controllers, and/or determine a status (i.e., closed or open) of one or more garage doors. One or more embodiments of the disclosure address these deficiencies by integrating a control peripheral 304 with garage door system control 302 and controller 306. As indicated by the double-ended arrow, the control peripheral 304 is configured to communicatively interface with garage door system control 302. The particular manner in which control peripheral 304 interfaces with garage door system control 302 can vary depending on the architecture of garage door system control 302. For instance, in some implementations, control peripheral 304 may communicatively interface with garage door system control 302 via a hard-wired serial interface (e.g., RS-232, I2C, SPI, etc.). Any other appropriate communicative interface is also within the scope of the present systems and methods.

Control peripheral 304 includes a hardware and/or software-based garage door system interface 304*a* configured to send commands to the garage system control 302, and to receive garage door status information from garage door system control 302. In some embodiments, garage door system interface 304*a* can be configured to supplement existing functionality of garage door system control 302. Control peripheral 304 may also include an interface 304*b* configured to communicate with a corresponding interface 306*b* of controller 306. According to one embodiment of the present disclosure, interface 304*b* and interface 306*b* may each comprise a wireless interface. According to another embodiment, interface 304*b* and interface 306*b* may each comprise a wired interface. Thus, control peripheral 304 is configured to transmit garage door status 310*a* to controller 306, and to receive garage door commands 310*b* from controller 306. Control peripheral 304 can be configured to send garage door status 310*a* at pre-defined intervals or in response to a particular request by controller 306 (as part of garage door commands 310*b*, for example). Garage door status 310*a* can include any combination of status information available from garage door system control 302.

As mentioned, control peripheral 304 is configured to receive garage door commands 310*b* from controller 306 via interface 304*b*. Garage door commands 310*b* can then be passed, via garage door system interface 304*a*, to garage door system control 302. Garage door system interface 304*a* can perform any conversion appropriate to facilitate communications between garage door system control 302 and controller 206 (e.g., converting garage door status 310*a* and/or garage door commands 310*b*).

In one or more embodiments, garage door system control 302 and control peripheral 304 can be combined as a single unit. Thus, instead of control peripheral 304 taking over or supplementing functionality of garage door system control 302, garage door system control 302 can itself be configured to communicate with controller 306 (e.g., by including a wireless interface, etc.) to send garage door status 310*a* to controller 306 and to receive garage door commands 310*b* from controller 206. Such an embodiment may be useful when initially installing a garage door system control 302 that integrates with the control panel 306, instead of adding this functionality to an already existing garage door system control.

Using control peripheral 304, controller 306 can centrally manage and control garage door system control 302. Controller 306 can comprise functionality typical of an alarm system controller. As shown, for instance, controller 306 is configured to interface with one or more alarm sensors 306*d* which can detect physical disturbances on the premises, such as those that would signal possible break-in attempts. Alarm sensors 306*d* can also detect other potentially dangerous situations, such as fire, flood, etc.

Controller 306 includes a hardware and/or software-based garage door module 306*a*, which is configured to intelligently and dynamically manage operation of garage door system control 302. At a basic level, garage door module 306*a* processes received garage door status 310*a* and sends garage door commands 310*b* to control peripheral 304. The status can include, for example, a state of one or more garage doors (i.e., whether the garage doors are open or closed). The garage door commands can comprise commands that directly instruct garage door system control 302 to change a state of one or more garage doors (i.e., open or close).

Furthermore, in addition to controlling and monitoring garage door status locally (e.g., at the garage door system control 302 and/or at controller 306), a user (e.g., a home or business owner, etc.) can use garage door control system 300 to manage and monitor one or more garage doors remotely over a network 314 using a remote computing device 308. For instance, as illustrated in FIG. 3, controller 306 is connected to network 314, such as a LAN, a WAN, or the Internet.

As illustrated, controller 306 is configured to communicate bi-directionally with one or more remote computing devices 308 through network 314, by sending garage door system related data 312*b* to each remote computing device 308, and by receiving remote garage door commands 312*a* from one or more remote computing devices 308. For example, a remote computing device 308 (e.g., a web client, a mobile client, etc.) can receive garage door system related data 312*b* regarding, for example only, present garage door status. Remote computing device 308 can then present this information to a user via one or more user interfaces. The user interfaces can present the information in any appropriate form. Thus, controller 306, by communicating with remote computing device(s) over network 314, can enable a user to access garage door system related data from virtually any location.

Further, the user interface at remote computing device 308 can be configured to enable remote user input. Thus, a user can enter, or cause to be generated, remote garage door commands 312*a*. Thus, alarm system controller 306, by interfacing with network 314 and exchanging garage door system related data 312*b* and remote garage door commands 312*a*, enables users to interact with their garage door system from remote computing devices 308, where they may view status and/or manually operate garage door system 302.

In one or more embodiments, garage door module 306*a* and/or remote computing device 308 can send a user alerts or other garage door system-related information. For instance, a user may be notified (e.g., via an e-mail, a SMS message, or other alert) when a status of a garage door has change, when the garage door system has malfunctioned, etc. It will be appreciated that these are only a few of the alerts that may be sent, and that any garage door system-related alert falls within this disclosure.

Figure 4:
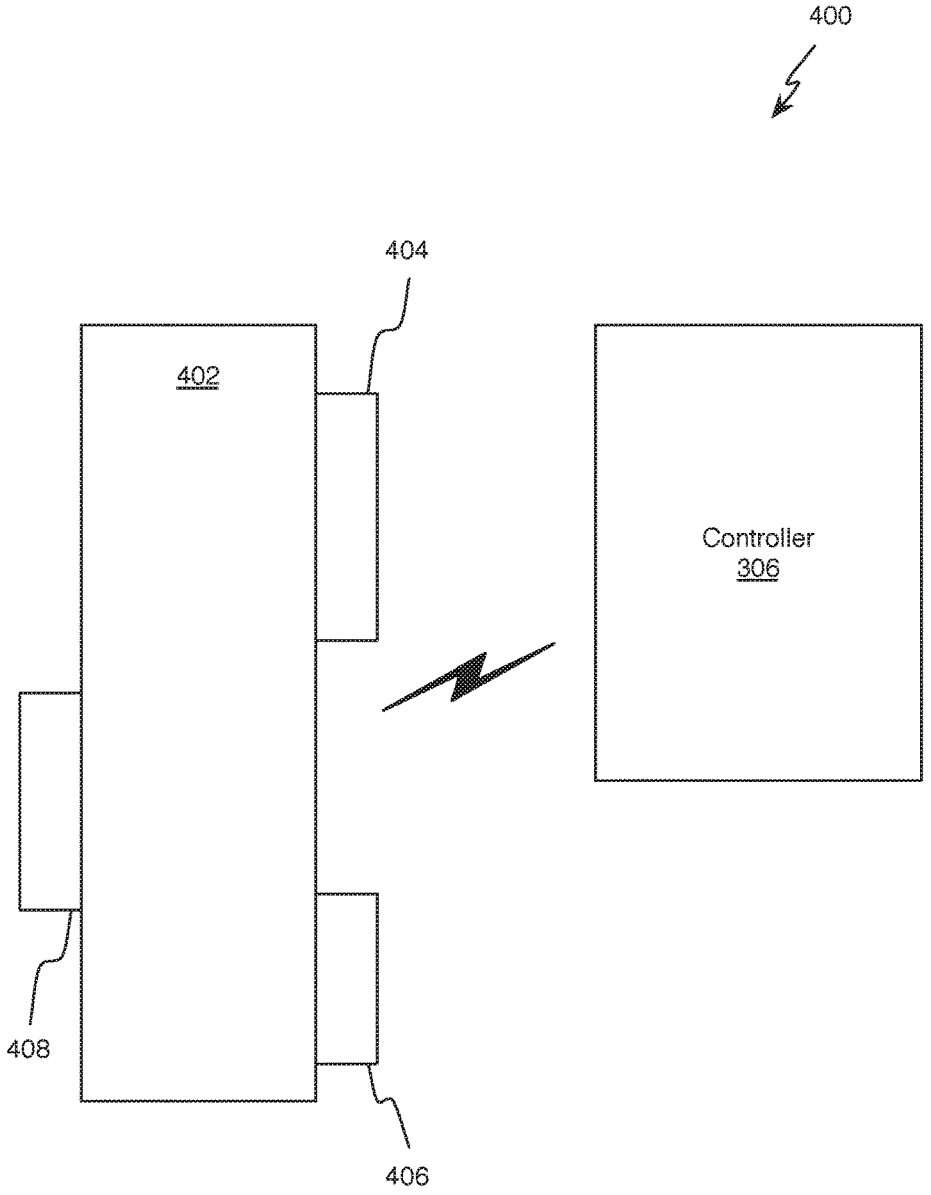
FIG. 4 depicts a garage door system, in accordance with an embodiment of the present disclosure.

FIG. 4 illustrates a garage door system 400, according to another embodiment of the present disclosure. Garage door system 400 includes controller 306, one or more garage doors 402, garage door controller 404, and at least one sensor 406. By way of example, garage door controller 404 may include garage door system control 302 and control peripheral 304, as illustrated in FIG. 3. Sensor 406, which may comprise any suitable sensor, may be configured to sense a state of a garage door 402 (i.e., open or closed) and convey the sensed data (i.e., whether the garage door is open or closed) to controller 306. Further, sensor 406 may be configured to detect a change of state of garage door 402 (e.g., from a closed state to an open state, or from an open state to a closed state) and send a signal to controller 306 indicative of the change of state. Further, according to one embodiment, sensor 406 may include a camera for capturing video and/or an image of a garage door system including garage door 402. More specifically, garage door system 400 may include a camera configured for capturing video and/or an image of garage door 402, or an area proximate thereto, and sending video and/or an image to controller 306, which may display the received video and/or image at controller 306. It is noted that sensor 406 may be configured for wireless communication and may communicate with controller 306 via garage door controller 404, or sensor 406 may communicate with controller 306 independent of garage door controller 404. According to one embodiment, controller 306 may include a relay control device (i.e., two-way toggle device) configured for toggling from one position to another position upon receipt of a signal indicating of garage door 402 changing state.

Further, garage door system 400 may include an alert device 408, which may comprise, for example, a speaker and/or a light. Alert device 408 may be configured to convey an alert after receipt of a command and prior to and/or during a change of state of garage door 402. Thus, upon receipt of a command to open or close a garage door at, for example, garage door controller 404, alert device 408 may convey an alert proximate garage door 402. Further, controller 306 may convey an alert via user interface 112 (e.g., see FIG. 1) prior to and/or during a change of state of garage door 402. By way of example, an alert may comprise a verbal alert, such as a recorded "garage door is closing" message or a beeping noise. As another example, an alert may comprise a visual alert, such as flashing light.

It is noted that sensor events (e.g., events detected by sensor 406) may be sent to monitoring system 103 (e.g., see FIG. 1). Therefore, a query for a status of garage door 402 may be made via monitoring system 103. As a more specific example, a user may request and receive the status of garage door 402 via monitoring system 103 at remote computing device 308 (e.g., see FIG. 3).

Figure 5:
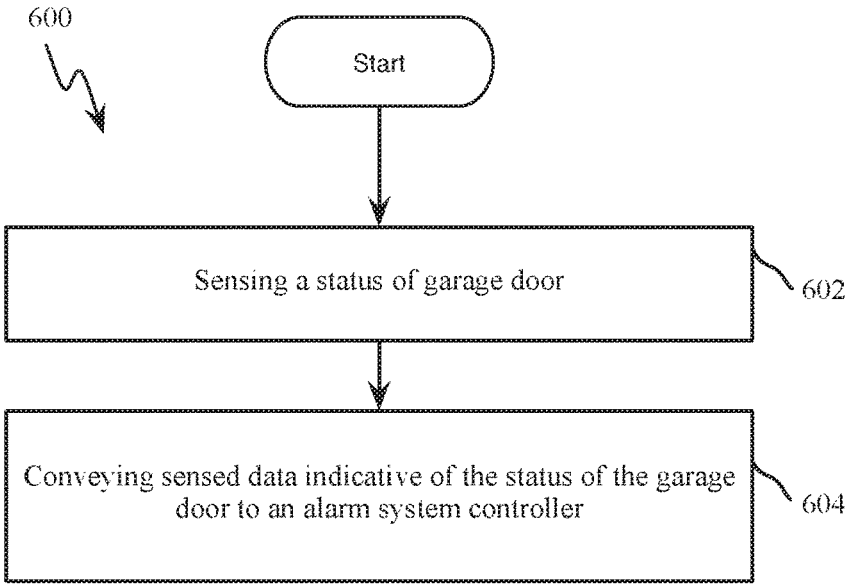
FIG. 5 is a flowchart of a method, according to an embodiment of the present disclosure.

FIG. 5 is a flowchart of a method 600, according to an embodiment of the present systems and methods. Method 600 includes sensing a status of a garage door (act 602). Method 600 further includes conveying sensed data indicative of the status of the garage door to an alarm system controller (act 604).

Figure 6:
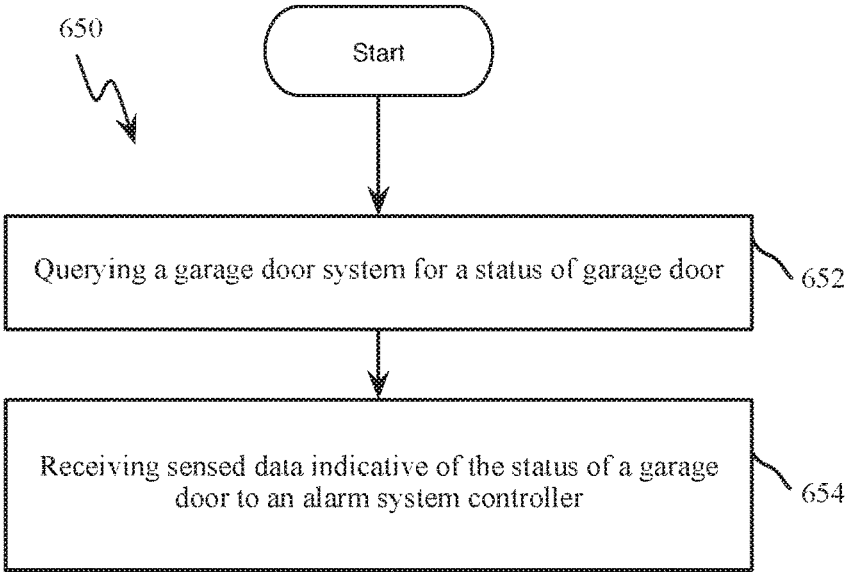
FIG. 6 is a flowchart of another method, according to an embodiment of the present disclosure.

FIG. 6 is a flowchart of another method 650, in accordance with an embodiment of the present systems and methods. Method 650 includes querying a garage door system for a status of a garage door (act 652). Additionally, method 650 includes receiving sensed data indicative of the status of a garage door at an alarm system controller (act 654).

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the systems and methods to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A system, comprising:

a garage door system control configured to:

operate at least one garage door;

transmit status information to a garage door control peripheral communicatively interfacing with the garage door system control; and receive command information from the control peripheral;

the garage door control peripheral configured to:

receive the status information from the garage door system control;

transmit the status information to a control panel communicatively coupled to the garage door peripheral;

receive the command information from the control panel; and transmit the command information to the garage door system control, wherein transmitting the command information and transmitting the status information comprises converting the command information and the status information to facilitate communications between the garage door system control and the control panel;

the control panel configured to:

receive the status information from the garage door control peripheral; and determine the command information for transmission to the garage door control peripheral, wherein the command information comprises direct instructions for the garage door system control to adjust an operable status of the at least one garage door based at least in part on the status information; and transmit the command information to the garage door control peripheral.

2. The system of claim 1, wherein the garage door control peripheral is further configured to:

facilitate the communicative interfacing with the garage door system control, wherein the garage door control peripheral comprises supplemental functionality of the garage door system control for bi-directional communication with the control panel.

3. The system of claim 1, wherein the garage door system control is further configured to:

establish direct communication with the control panel, wherein the garage door control peripheral is communicatively integrated with the garage door system control at a single unit.

4. The system of claim 1, wherein the garage door system control is further configured to:

associate the garage door control peripheral with a legacy garage door opener, wherein the legacy garage door opener is communicatively coupled to the garage door control peripheral.

5. The system of claim 1, wherein the garage door control peripheral is further configured to:

transmit the status information at one or more pre-configured intervals associated with a timing functionality of the garage door system control, a timing functionality of the control panel, or both.

6. The system of claim 5, wherein the garage door control peripheral is further configured to:

transmit additional status information at one or more instances asynchronous to the one or more pre-configured intervals, wherein the transmission is initialized based at least in part on a received garage door status query request of the control panel.

7. The system of claim 1, wherein the status information comprises at least one of a current state of the at least one garage door and a state change of the at least one garage door.

8. The system of claim 1, wherein the garage door control peripheral is further configured to:

receive at least one sensor indication associated with the status information, wherein the at least one sensor indication is generated by one or more coupled sensors configured for wireless communication.

9. The system of claim 1, further comprising:

one or more sensors configured to receive at least one sensor indication associated with the status information, wherein the at least one sensor indication is independent of the garage door control peripheral.

10. The system of claim 1, wherein the control panel is further configured to:

toggle a coupled relay control device from a first position to a second position in response to the received data.

11. The system of claim 1, further comprising:

one or more sensors configured to receive at least one sensor indication associated with detection of physical disturbances at a premises of the system.

12. The system of claim 1, wherein the garage door control peripheral is further configured to:

transmit the command information of the control panel to at least one of a legacy garage door opener and the garage door system control.

13. The system of claim 1, further comprising:

an alert device configured to convey at least one of an audible alert or a visual alert proximal to the at least one garage door, wherein the audible alert or the visual alert, or both is initiated prior to, during, or subsequent to an adjustment in operable status of the at least one garage door.

14. The system of claim 1, further comprising:

a remote user computing device configured to enable a wireless interface with the control panel, wherein the wireless interface is configured for remote user input at the control panel.

15. The system of claim 14, wherein the remote user computing device is further configured to:

receive a multimedia message corresponding to an adjustment in operable status of the at least one garage door.

16. The system of claim 1, wherein the garage door control peripheral is further configured to:

capture, via a coupled camera, an image or a video associated with a focal area corresponding to the at least one garage door; and route the captured image or video to the control panel.

17. A garage door control peripheral, comprising:

a processor;

a memory in electronic communication with the processor; and instructions stored in the memory, the instructions being executable by the processor to:

receive status information from a garage door system control;

transmit the status information to a control panel communicatively coupled to the garage door peripheral;

receive information from the control panel;

identify the received information as command information of the control panel, the command information comprising direct instructions for the garage door system control to adjust an operable status of at least one garage door based at least in part on the status information; and transmit the command information to the garage door system control, wherein transmitting the command information and transmitting the status information comprises converting the command information and the status information to facilitate communications between the garage door system control and the control panel.

18. A non-transitory computer-readable medium storing computer-executable code, the code executable by a processor to:

receive status information from a garage door system control;

transmit the status information to a control panel communicatively coupled to the garage door peripheral;

receive information from the control panel;

identify the received information as command information of the control panel, the command information comprising direct instructions for the garage door system control to adjust an operable status of at least one garage door based at least in part on the status information; and transmit the command information to the garage door system control, wherein transmitting the command information and transmitting the status information comprises converting the command information and the status information to facilitate communications between the garage door system control and the control panel.

19. The garage door control peripheral of claim 17, wherein the instructions are further executable by the processor to:

receive at least one sensor indication associated with the status information, wherein the at least one sensor indication is generated by one or more coupled sensors configured for wireless communication.

* * * * *